US008701893B2

(12) United States Patent
Tung et al.

(10) Patent No.: US 8,701,893 B2
(45) Date of Patent: Apr. 22, 2014

(54) MAGNETIC SEPARATION DEVICE AND METHOD FOR SEPARATING MAGNETIC SUBSTANCE IN BIO-SAMPLES

(75) Inventors: Mean-Jue Tung, Kinmen County (TW); Li-Kou Chen, Hsinchu (TW); Yu-Ting Huang, Hsinchu County (TW); Hsin-Hsin Shen, Hsinchu County (TW); Wei-Lin Yu, Hsinchu County (TW); Yi-Shan Lin, Taipei (TW); Shinn-Zong Lin, Taichung (TW); Woei-Cherng Shyu, Taipei (TW); Hsiao-Jung Wang, Hualien County (TW)

(73) Assignee: Industrial Technology Research Institute, Hsinchu (TW)

( * ) Notice: Subject to any disclaimer, the term of this patent is extended or adjusted under 35 U.S.C. 154(b) by 445 days.

(21) Appl. No.: 12/761,339

(22) Filed: Apr. 15, 2010

(65) Prior Publication Data

US 2011/0147278 A1 Jun. 23, 2011

(30) Foreign Application Priority Data

Dec. 23, 2009 (TW) ..... 98144433 A

(51) Int. Cl.
*B03C 1/00* (2006.01)

(52) U.S. Cl.
USPC ..... 209/214; 209/232; 210/222

(58) Field of Classification Search
USPC ..... 209/39, 213, 214, 223.1, 232; 210/222, 210/695
See application file for complete search history.

(56) References Cited

U.S. PATENT DOCUMENTS

| | | | | |
|---|---|---|---|---|
| 5,411,863 | A | 5/1995 | Miltenyi | |
| 5,711,871 | A | 1/1998 | Miltenyi | |
| 6,120,735 | A | 9/2000 | Zborowski et al. | |
| 6,417,011 | B1 | 7/2002 | Miltenyi | |
| 6,572,778 | B2 | 6/2003 | Sterman et al. | |
| 7,486,166 | B2 | 2/2009 | Humphries et al. | |
| 7,892,427 | B2 * | 2/2011 | Barbic et al. | 210/222 |
| 2003/0015474 | A1 | 1/2003 | Sterman et al. | |
| 2004/0108253 | A1 * | 6/2004 | Broyer et al. | 209/214 |
| 2009/0152176 | A1 * | 6/2009 | Kipp et al. | 209/562 |

FOREIGN PATENT DOCUMENTS

| | | |
|---|---|---|
| CN | 2609931 Y | 4/2004 |
| CN | 1894395 | 1/2007 |
| CN | 101164700 | 4/2008 |

(Continued)

OTHER PUBLICATIONS

Taiwan Patent Office, Notice of Allowance, Patent Application Serial No. 098144433, Mar. 21, 2012, Taiwan.

*Primary Examiner* — Joseph C Rodriguez
*Assistant Examiner* — Kalyanavenkateshware Kumar

(57) ABSTRACT

A magnetic separation device is provided, including a first magnetic field unit and a first separation unit disposed at a side of the first magnetic field unit. The first magnetic field unit includes a first magnetic yoke having opposite first and second surfaces, and a plurality of first magnets respectively disposed over the first and second surfaces, wherein the same magnetic poles of the plurality of first magnets face the first magnetic yoke. The first separation unit includes a body made of non-magnetic materials and a continuous piping disposed in the body, including at least one first section and at least one second section, wherein at least one second section is perpendicular to at least one first section, and at least one second section is adjacent to, and in parallel to a side of the first magnetic yoke not in contact with the plurality of first magnets.

22 Claims, 17 Drawing Sheets

(56) References Cited

FOREIGN PATENT DOCUMENTS

| | | | |
|---|---|---|---|
| EP | 0941766 | A2 | 9/1999 |
| EP | 1308211 | A2 | 5/2003 |
| TW | 181908 | | 4/1992 |
| WO | WO 99/19071 | | 4/1999 |
| WO | WO 2008/133726 | A2 | 11/2008 |

* cited by examiner

MAGNETIC SEPARATION DEVICE AND METHOD FOR SEPARATING MAGNETIC SUBSTANCE IN BIO-SAMPLES

CROSS REFERENCE TO RELATED APPLICATIONS

This application claims priority of Taiwan Patent Application No. 98144433, filed on Dec. 23, 2009, the entirety of which is incorporated by reference herein.

TECHNICAL FIELD

The disclosure relates to bio-separation devices, in particular to magnetic separation devices capable of separating magnetic substances in bio-samples and methods for separating magnetic substances in bio-samples.

BACKGROUND

In the field of biology, a technique for efficiently separating one type or class of cell from a complex cell suspension would have wide applications. The ability to remove certain cells from a clinical blood sample that were indicative of a particular disease state could be useful as a diagnostic for that disease.

It has been shown that cells tagged with micron sized (>1 μm) magnetic or magnetized particles can be successfully removed or separated from mixtures using magnetic devices. For the removal of desired cells, i.e., cells which provide valuable information, the desired cell population is magnetized and removed from the complex liquid mixture (so-called positive selection or positive separation). In an alternative method, the undesirable cells, i.e., cells that may prevent or alter the results of particular procedure, are magnetized and subsequently removed with a magnetic device (so-called negative selection or negative separation).

U.S. Pat. No. 6,572,778 discloses a magnetic device formed with an arrangement including four polar magnets and a plurality of interpolar magnets for providing a magnetic field that may attract magnetized particles in bio-samples toward interior walls of a piping disposed between the polar magnets and interpolar magnets. However, the strength of the magnetic field provided by this magnetic device is limited by the remanent induction (Br) of the magnets materials used therein, such that the magnetic device fails to provide the magnetic field with a sufficiently powerful attraction against the magnetized particles in the bio-samples for the purpose of improving bio-separation efficiency.

SUMMARY

An exemplary magnetic separation device comprises a first magnetic field unit, and a first separation unit disposed at the side of the first magnetic field unit. The first magnetic field unit comprises a first magnetic yoke having opposite first and second surfaces, and a plurality of first magnets respectively disposed over the first and second surfaces, wherein the same magnetic poles of the plurality of first magnets face the first magnetic yoke. The first separation unit comprises a body made of non-magnetic materials, a continuous piping disposed in the body, comprising at least one first section and at least one second section, wherein at least one second section is perpendicular to at least one first section, and at least one second section is adjacent to and is parallel to a side of the first magnetic yoke not in contact with the plurality of first magnets.

An exemplary method for separating magnetic substances in a bio-sample comprises providing an above magnetic separation device. A solution of bio-sample is provided, wherein the solution of the bio-sample comprises magnetic bio-substances or bio-substances labeled by magnetic target. The solution of the bio-sample is pumped through the continuous piping in the magnetic separation device, and thereby the magnetic bio-substances or bio-substances labeled by the magnetic target are attracted or repelled toward a sidewall of one of the second sections which is adjacent to and in parallel to the first magnetic yoke and portions of a sidewall of the first sections. The first magnetic field unit is then separated from the first separation unit. A buffer solution is provided to flow through the continuous piping of the first separation unit to thereby elute the magnetic bio-substances or bio-substances labeled by magnetic targets left on the sidewall of one of the second sections and portions of the sidewall of the first sections.

A detailed description is given in the following embodiments with reference to the accompanying drawings. It is to be understood that both the foregoing general description and the following detailed description are exemplary and explanatory only, and are not restrictive of the claimed invention.

BRIEF DESCRIPTION OF THE DRAWINGS

The invention can be more fully understood by reading the subsequent detailed description and examples with references made to the accompanying drawings, wherein.

DETAILED DESCRIPTION

The following description is of the best-contemplated mode of carrying out the invention. This description is made for the purpose of illustrating the general principles of the invention and should not be taken in a limiting sense. The scope of the invention is best determined by reference to the appended claims.

Magnetic separation devices according to various embodiments of the invention are illustrated in FIGS. 8-13 and details thereof are discussed in the following paragraphs, wherein each of the separation devices comprises at least one magnetic field unit and at least one separation unit therein.

FIGS. 1-4 are schematic diagrams respectively showing a magnetic field unit utilized in the magnetic separation devices illustrated in the FIGS. 8-13, and FIGS. 5-7 are schematic diagrams respectively showing a separation unit utilized in the magnetic separation devices illustrated in the FIGS. 8-13.

Figure 1:
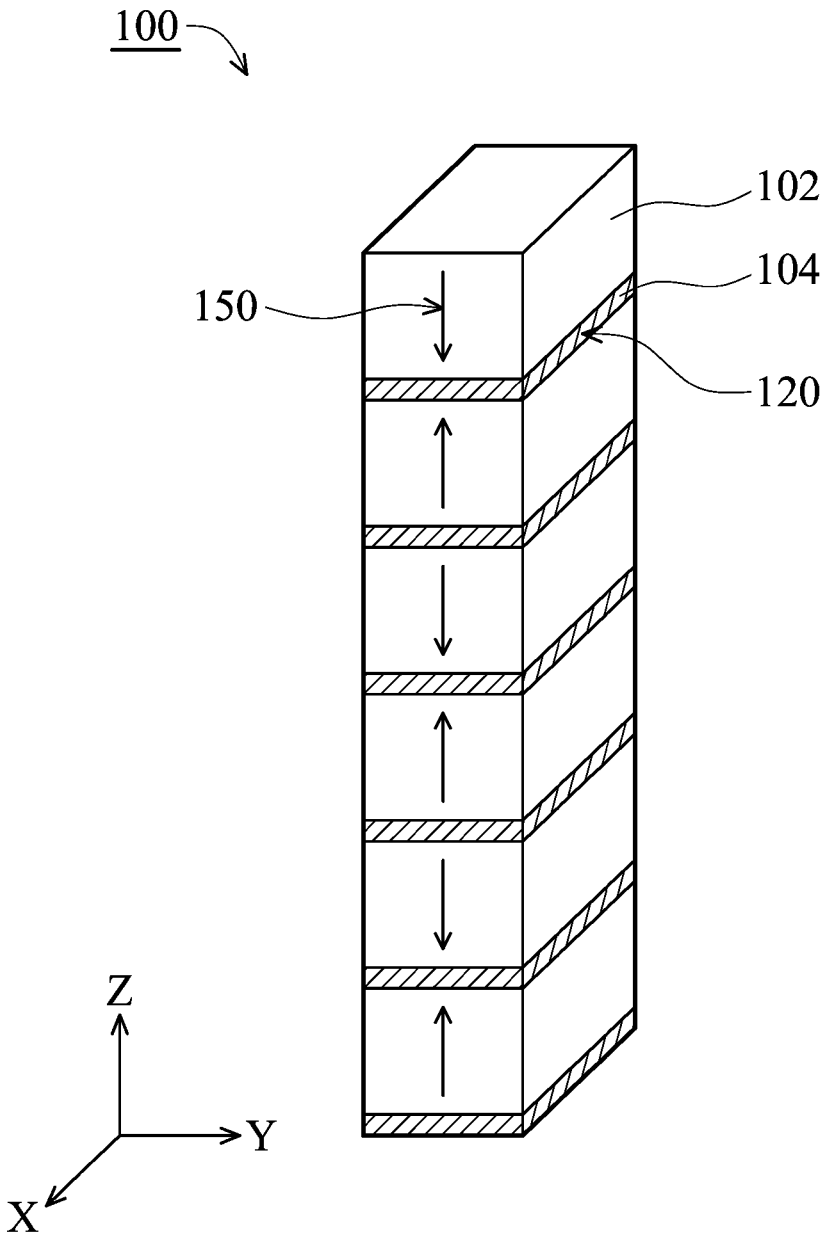
FIG. 1 is a schematic diagram showing a magnetic field unit according to an embodiment of the invention.

As shown in FIGS. 1-4, magnetic field units according to various embodiments of the invention are illustrated. FIG. 1 illustrates a perspective diagram of an exemplary magnetic field unit 100, comprising a plurality of magnets 102 and a magnetic yoke 104 respectively interposed between these magnets 102. In this embodiment, the magnets 102 are illustrated as a rectangular pillar and the magnetic yoke 104 is illustrated as a rectangular plate. As shown in FIG. 1, two of the magnets 102 in the magnetic field unit 100 are disposed on opposite surfaces of the magnetic yoke 104, and the same magnetic pole of these two magnets 102 faces the magnetic yoke 104. Herein, arrow 150 represents an interior magnetic field direction from a south pole toward a north pole of each of the magnets 102.

In the magnetic field unit 100 shown in FIG. 1, the magnets 102 and the magnetic yokes 104 are formed with similar shapes and similar surface areas such that the magnetic field unit 100 is now illustrated as a rectangular pillar having a plurality of planar sidewall surfaces. Herein, the magnets 102 are formed with a surface area $A_m$ in contact with the magnetic yoke 104, and a sidewall surface 120 of each of the magnetic yokes 104 not in contact with the magnets 102 is formed with a surface area $A_y$. Due to the continuity of magnetic flux lines, a magnetic flux density B at the sidewall surface 120 of the magnetic yoke 104 not in contact with the magnets 102 is defined as follows:

$$B=2B_dA_m/A_y \quad (1)$$

Wherein $B_d$ represents a working magnetic flux density of the magnets 102, typically having a maximum value the same as a remanent flux density (Br) of the magnets 102, and the working magnetic flux density ($B_d$) is typically affected by factors such as shapes and demagnetization fields and typically less than the remanent flux density (Br). Adequately selected $A_m$ and $A_y$ may provide a strong magnetic field which may be greater than the remanent flux density (Br) of the magnets 102 at each of the sidewall surfaces 120 of the magnetic yoke 104 not in contact with the magnets 102, such that can be used in a process for separating magnetic substances in bio-samples. Herein, due to the arrangement of a plurality of magnetic yokes 104, a plurality of areas having strong magnetic fields capable of separating magnetic substances in bio-samples are provided in the magnetic field unit 100.

Figure 2:
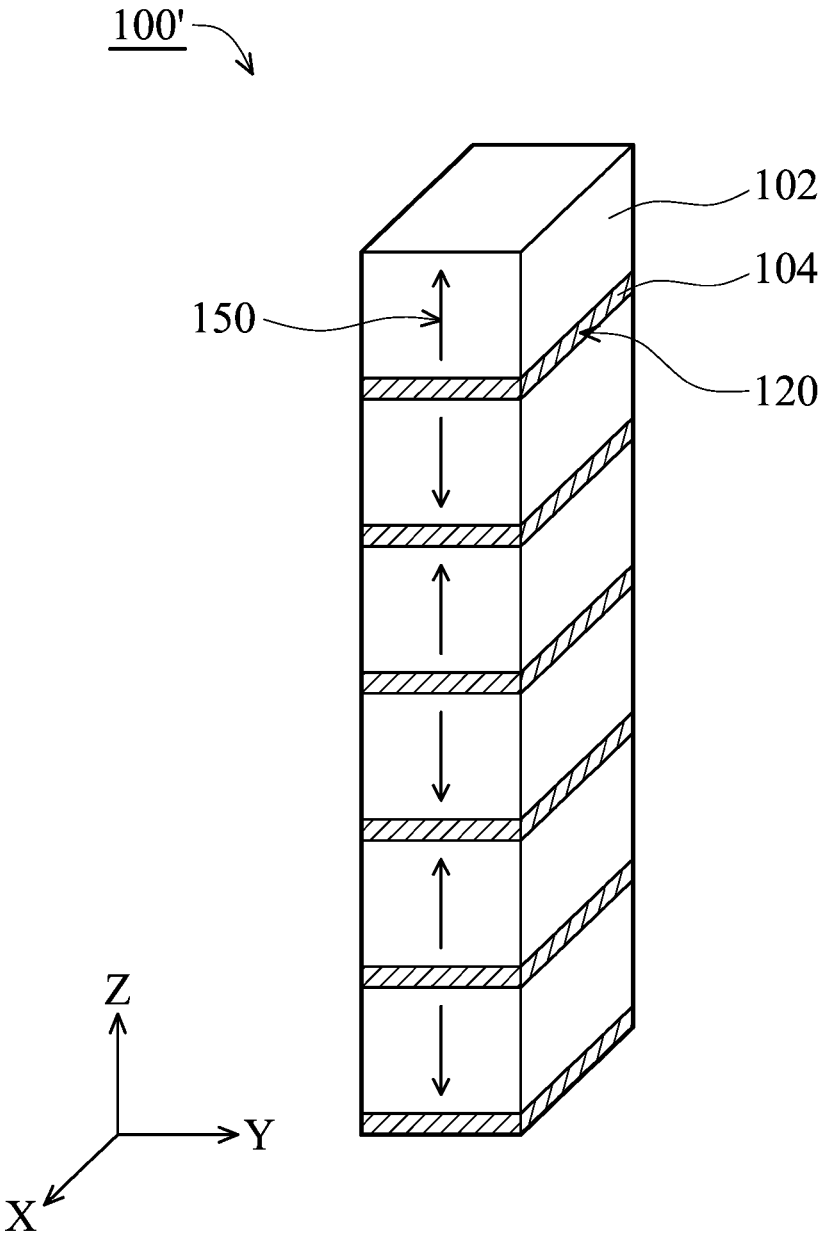
FIG. 2 is a schematic diagram showing a magnetic field unit according to another embodiment of the invention.

FIG. 2 illustrates a perspective diagram of another exemplary magnetic field unit 100' similar to the magnetic field unit 100 illustrated in FIG. 1. Herein, the same references represent the same components, and only differences between the magnetic field units 100 and 100' are discussed as follows.

As shown in FIG. 2, the magnetic field unit 100' is also formed with a plurality of magnets 102 and a plurality of magnetic yokes 104 respectively disposed between these magnets 102, and directions of interior magnetic field (represented as arrow 150) in the magnets 102 in the magnetic field unit 100' are now opposite to that of the magnets 102 located at the same places in the magnetic field unit 100 in FIG. 1. As to the arrangement shown in FIG. 2, a strong magnetic field can be thus formed near a sidewall surface 120 of each of the magnetic yokes 104 in the magnetic field unit 100', and the magnetic field unit 100' thus have a plurality of areas of strong magnetic fields which are greater than the remanent flux density (Br) of the magnets 102.

Figure 3:
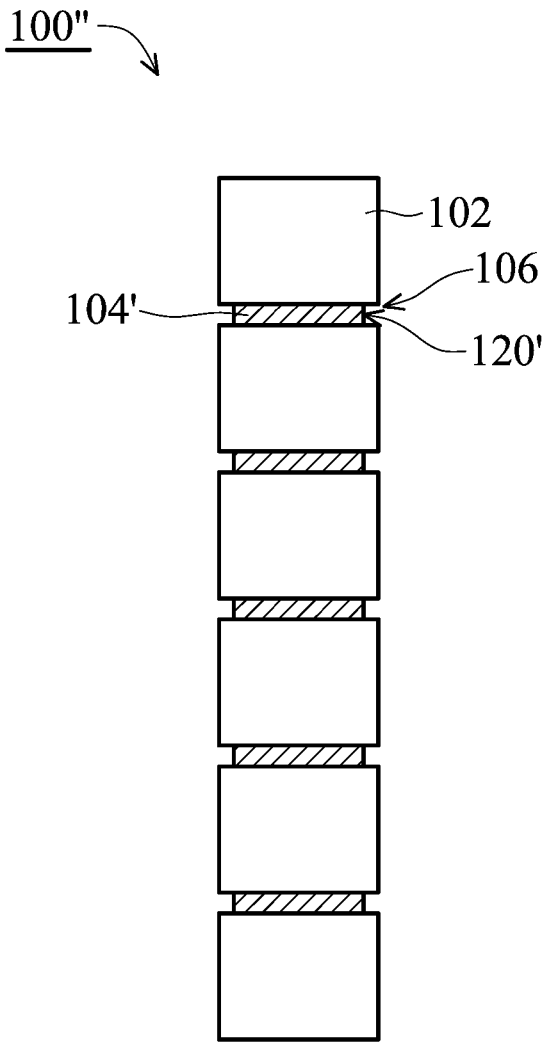
FIG. 3 is a schematic diagram showing a magnetic field unit according to yet another embodiment of the invention.

FIG. 3 illustrates a schematic diagram showing a cross section of another magnetic field unit 100" that is similar to the magnetic field units 100 and 100' disclosed in FIGS. 1-2. Herein, the same references represent the same components and only differences therebetween are discussed as follows.

As shown in FIG. 3, the magnetic field unit 100" is also formed of a plurality of magnets 102 and a plurality of magnetic yokes 104' respectively interposed therebetween, and directions of an interior magnetic field of the magnets 102 can be the same with the directions of the magnets 102 of the magnetic field unit 100 or 100' illustrated in FIG. 1 or FIG. 2. In this embodiment, the magnetic yokes 104' and the magnets 102 in the magnetic field unit 100" have different surface areas, and a surface area of one of the magnetic yokes 104' is slightly less than the surface area of the two of the magnets 102 adjacent thereto.

Therefore, a gap 106 is thus formed between the two magnets 102 and the magnetic yoke 104' interposed therebetween, and the gap 106 exposes a sidewall surface 120' of the magnetic yoke 104'. However, a strong magnetic field is still formed at the respective sidewall surface 120' of each of the magnetic yokes 104' of the magnetic field unit 100", and the magnetic field unit 100" may still have a plurality of areas of strong magnetic fields which are greater than a remanent flux density (Br) of the magnets 102.

Figure 4:
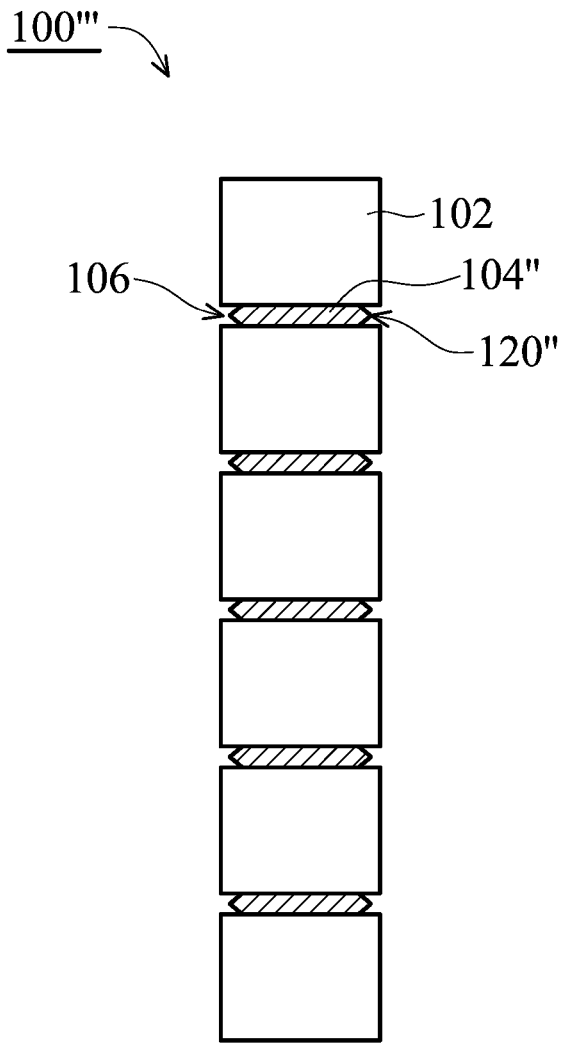
FIG. 4 is a schematic diagram showing a magnetic field unit according to another embodiment of the invention.

FIG. 4 illustrates a schematic diagram showing a cross section of another magnetic field unit 100' similar with the magnetic field unit 100" disclosed in FIG. 3. Herein, the same references represent the same components and the only differences therebetween are discussed as follows.

As shown in FIG. 4, the magnetic field unit 100'" is formed of a plurality of magnets 102 and a plurality of magnetic yokes 104" respectively interposed between the magnets, and the magnets 102 and the magnetic yokes 104" now have different surface areas, and a surface area of the magnetic yokes 104" is slightly less than that of the magnets 102. Thus, a gap 106 is formed between the two magnets 102 and the magnetic yoke 104" interposed therebetween, and the gap 106 exposes a sidewall surface 120" of the magnetic yoke 104". In this embodiment, the sidewall surface 120" of the magnetic yoke 104" is illustrated as a convex surface but is not limited thereto. The sidewall surface 120" of the magnetic yoke 104" can be formed with a curved surface or a sawtooth-like surface (both not shown). A strong magnetic field area is thus formed near a sidewall surface 120" of each of the magnetic yokes 104" in the magnetic field unit 100', and the magnetic field unit 100' are now provided with a plurality of areas of strong magnetic field areas which are greater than a remanent flux density (Br) of the magnets 102.

The magnets 102 used in the magnetic field units 100, 100', 100", and 100' illustrated in FIGS. 1-4 can be formed of materials such as NdFeB, SmCo, SmFeN, AlNiCo, ferrite, or combinations thereof. The magnets 102 can be formed in a configuration other than the rectangular pillar, such as circular pillar, triangular pillar or other polygonal pillar. In addition, the magnetic yokes 104, 104', and 104" used in the magnetic field units 100, 100', 100", and 100'" illustrated in FIGS. 1-4 can be formed of materials such as pure iron, magnetic stainless steel or metal soft magnetic materials having predetermined permeability. Metal soft magnetic materials having predetermined permeability can be, for example, iron, silicon steel, NiFe, CoFe, stainless steel, soft magnetic ferrites, or combinations thereof. In one embodiment, the magnets 102 used in the magnetic field units 100, 100', 100", and 100'" can be provided with a thickness greater than 1 mm for easy application, but is not limited thereto, and the magnetic yokes 104, 104' and 104" can be provided with a thickness of about 0.5~10 mm.

In addition, for the purpose of fabricating the components, a non-magnetic frame (not shown) made of materials such as stainless steel or aluminum alloys can be further provided for covering the magnetic field units 100, 100', 100", and 100'" shown in FIGS. 1-4 from outside thereof. The non-magnetic frame can be also provided with an opening or a slot at a place near each of the magnetic yokes 104, 104' and 104" used in the magnetic field units 100, 100', 100", and 100'" to expose sidewall surfaces 120/120'/120" of the magnetic yokes 104, 104' and 104", respectively.

Figure 5:
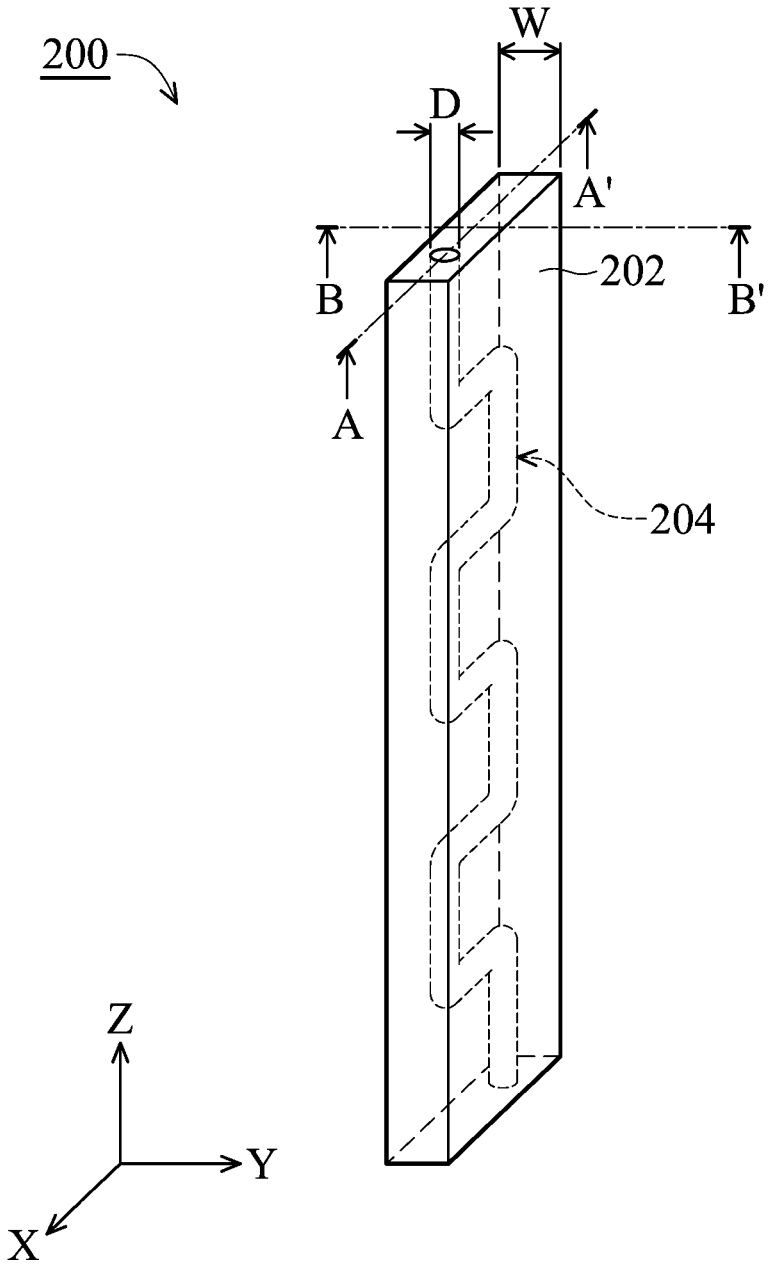
FIG. 5 is a schematic diagram showing a separation unit according to an embodiment of the invention.
Figure 6:
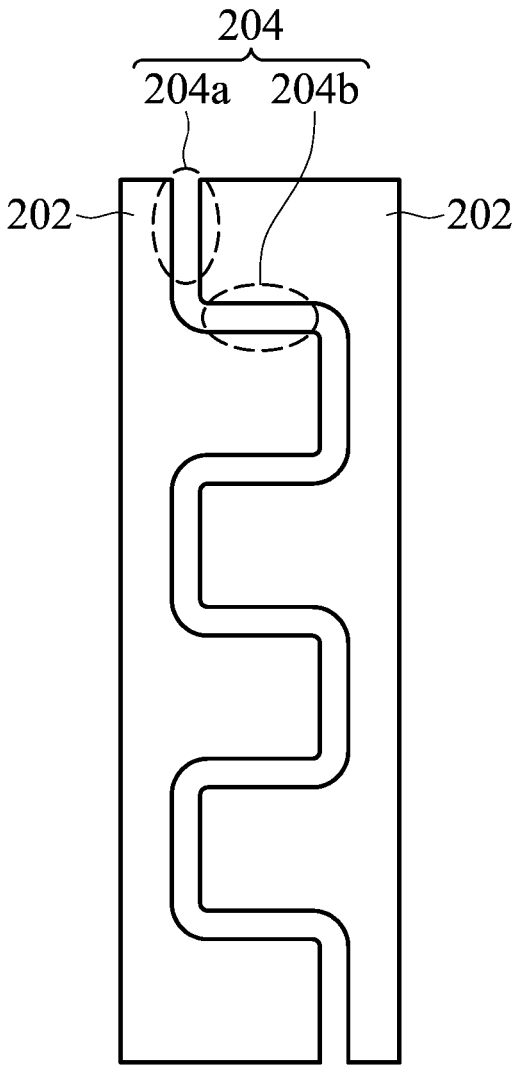
FIG. 6 is a schematic diagram showing a cross section along line A-A' in FIG. 5.
Figure 7:
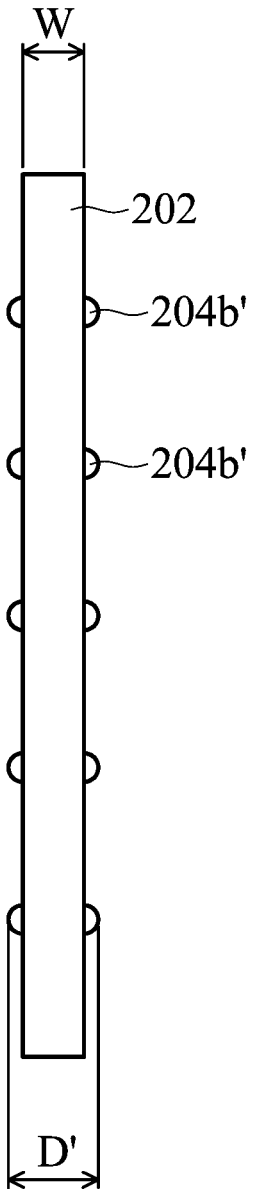
FIG. 7 is a schematic diagram showing a cross section along line B-B' in FIG. 5.

FIGS. 5-7 are schematic diagrams showing separation units used in the magnetic separation device according to various embodiments of the invention.

FIG. 5 illustrates a perspective diagram of an exemplary separation unit 200, including a body 202 made of non-magnetic materials and a continuous piping 204 disposed in the body 202. Herein the continuous piping 204 passes through the body 202 for top toward bottom thereof to thereby pump a solution of bio-sample through the separation unit 200.

FIG. 6 illustrates a cross section of the separation unit 200 taken along a line A-A' in FIG. 5. Herein, the continuous piping 204 in the separation unit 200 comprises a plurality of first sections 204*a* and a plurality of second sections 204*b* arranged in order, thereby forming the continuous piping 204 passing through the body 202 from top toward bottom thereof. The first sections 204*a* and the second sections 204*b* are substantially perpendicular to each other. Herein, the first sections 204*a* are illustrated as portions of the piping in perpendicular to a short side of the body 202 and the topmost pipe of the first section 204*a* may function as an input end for receiving a solution of bio-sample, and the bottommost pipe of the first section 204*a* may function as an output end for exhausting the solution of bio-sample.

In FIGS. 5-6, a diameter D of the continuous piping 204 can be less than or the same as a width W of the body along a Y axis thereof, but is not limited thereto. As shown in FIG. 7, a cross section taken along a line B-B' of the separation unit illustrated in FIG. 5 shows a diameter D' of the sections 204*b* is greater than a width W of the body 202 along the Y axis, thereby having protruding portions 204*b* protruding over the side of the body 202.

In the separation units shown in FIGS. 5-7, the continuous piping 204 can be formed by non-magnetic materials such as polymethyl methacrylate (PMMA), polyvinyl chloride (PVC), polyurethane (PU), silicon, or Teflon, and the body 202 can be formed by non-magnetic materials such as polymethyl methacrylate (PMMA), acrylic, polypropylene (PP), polyethylene (PE), polyvinyl chloride (PVC), Teflon, or bakelite. The body 202 is formed with a plate-like configuration, having width W of about 1~15 mm along a Y axis of the separation unit. The width W can be properly adjusted according to a distance between opposing magnetic field units.

FIGS. 8-13 illustrate magnetic separation devices according to various embodiments of the invention, wherein each of the magnetic separation devices may incorporate the magnetic field units and the separation units described and illustrated above.

Figure 8:
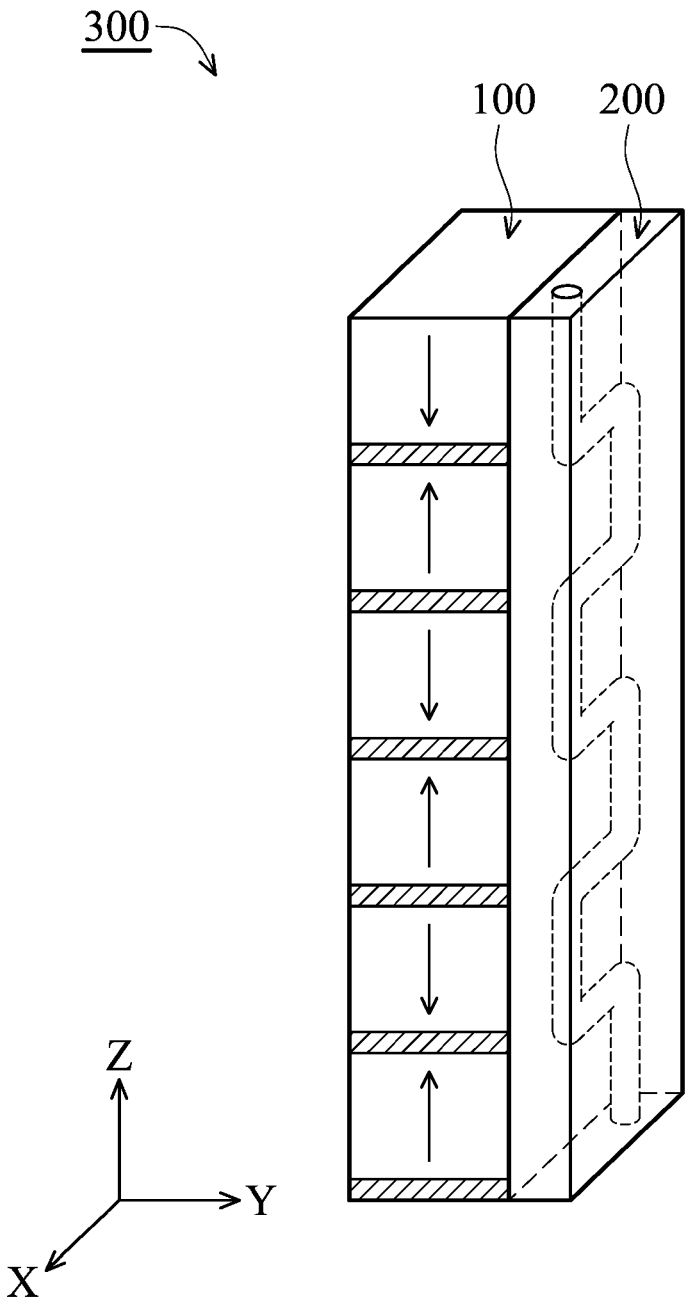
FIG. 8 is a schematic diagram showing a magnetic separation device according to an embodiment of the invention.

FIG. 8 illustrates an exemplary magnetic separation device 300 comprising a magnetic field unit 100 shown in FIG. 1 and a separation unit 200 shown in FIG. 5. Herein, the separation unit 200 is disposed at a side of the magnetic field unit 100 by methods such as hooking or adhering, and the second section 204*b* in the continuous piping 204 of the separation unit 200 is respectively adjacent to and in parallel to a side of each of the magnetic yokes 104 in the magnetic field unit 100. In such a configuration shown in FIG. 1, magnetic flux lines (not shown) of two magnets adjacent to one of the magnetic yokes 104 in the magnetic field unit 100 are gathered to the magnetic yoke 104 interposed therebetween, and the magnetic flux lines are further guided to the second sections 204*b* of the separation unit 200 which are in parallel to the magnetic yoke 104, thereby making the second sections 204*b* as main separation portions in the magnetic separation device 300 for separating magnetic substances in a solution of bio-sample, and the first sections 204*a* in the separation unit 200 which are adjacent to one of the magnets 102 may function as an inlet and an outlet for the solution of the bio-sample and interconnect the second sections 204*b* in the separation unit 200. Portions of the first sections 204*a* adjacent to the second sections 204*b* may still provide separation benefits due to close placement near the magnetic yoke 104.

Figure 9:
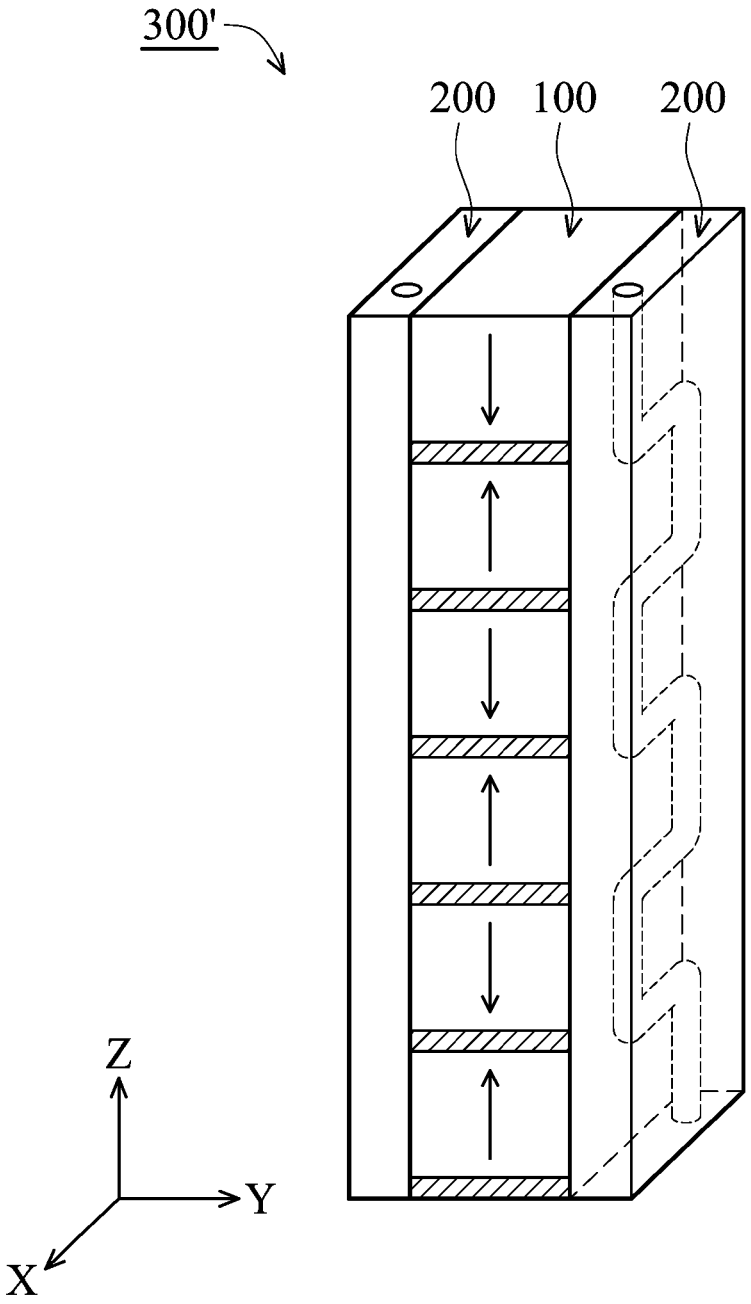
FIG. 9 is a schematic diagram showing a magnetic separation device according to another embodiment of the invention.

FIG. 9 illustrates another exemplary magnetic separation device 300' similar to the magnetic separation device 300 illustrated in FIG. 8. Herein, the same references represent the same components, and the only differences there between are discussed in the following paragraphs.

As shown in FIG. 9, the magnetic separation device 300' comprises a magnetic field unit 100 shown in FIG. 1 and two separation units 200 shown in FIG. 5. The separation units 200 are disposed on opposite sides of the magnetic field unit 100, respectively. Through such a configuration shown in FIG. 9, the magnetic separation device 300' may provide a magnetic separation process for simultaneously separating more than one set of solutions of the bio-samples, thereby improving throughputs and efficiencies of the magnetic separation process.

In other embodiments, configurations of the separation unit 200 in the magnetic separation device are not limited by those illustrated in FIGS. 8-9. A separation unit may be provided at each side of the magnetic separation device, or the magnetic field unit 100 used therein may be replaced by the magnetic field units 100', 100", and 100' illustrated in FIGS. 2-4, or the separations units 200 can be located at adjacent sides of the magnetic field unit to improve throughputs and efficiencies of a magnetic separation process. As the separation unit 200 is provided in combination with the magnetic field unit 100" and 100' illustrated in FIGS. 3-4, the separation unit illustrated in FIG. 7 can be utilized such that the recesses 106 in the magnetic field units 100" and 100'" can install the protruding portions 204*b* of the second sections of the continuous piping.

Figure 10:
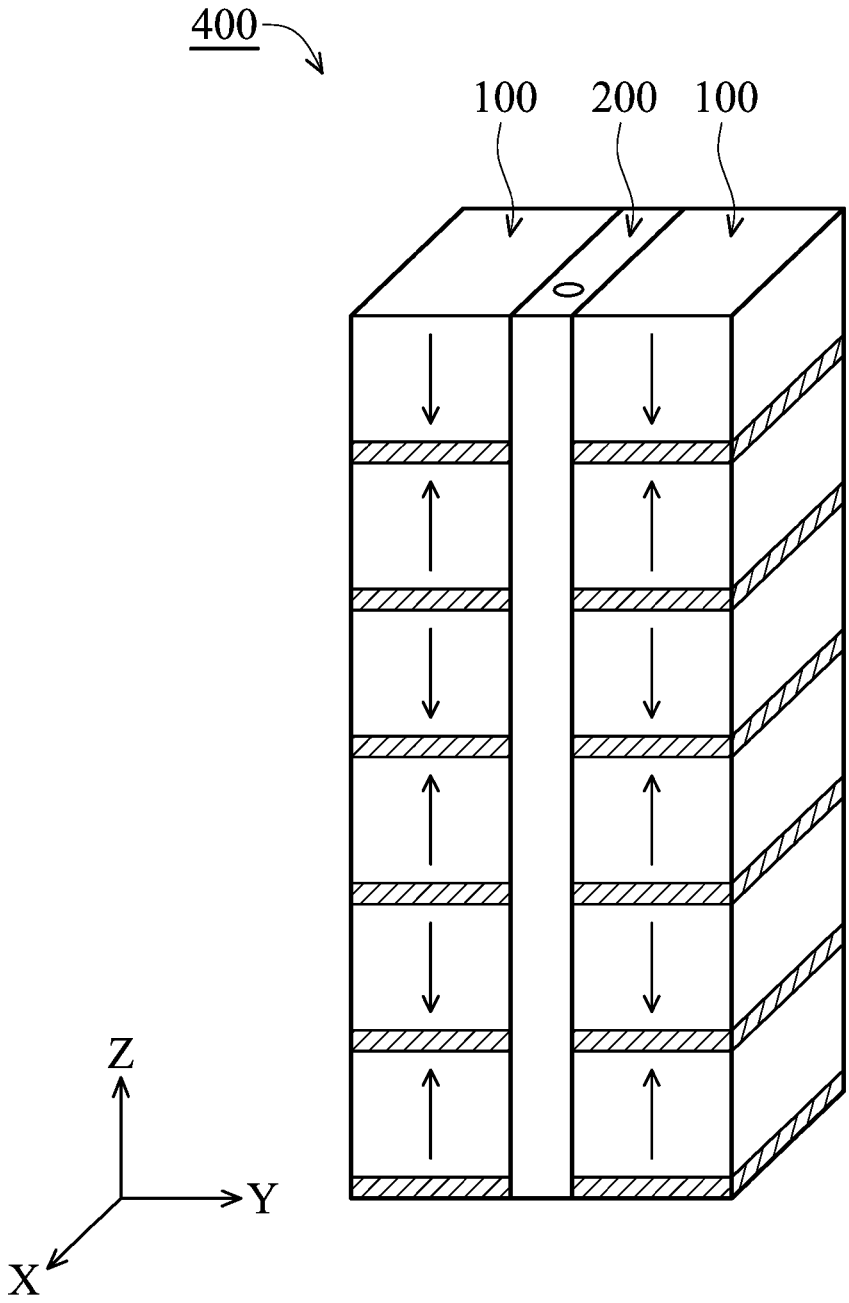
FIG. 10 is a schematic diagram showing a magnetic separation device according to yet another embodiment of the invention.

FIG. 10 illustrates another exemplary magnetic separation device 400, comprising two magnetic field units 100 shown in FIG. 1 and a separation unit 200 shown in FIG. 5. Herein the separation unit 200 is interposed between the magnetic field units 100, and the separation unit 200 can be disposed at a side of each of the magnetic field units 100 by methods such as hooking or adhering, and the second sections 204*b* in the continuous piping 204 in the separation unit 200 are respectively adjacent to and in parallel to a side of each of the magnetic yokes 104 of the magnetic field units 100 not in contact with the magnets 102.

Due to such a configuration of the magnetic field unit 100, magnetic flux lines (not shown) of two magnets adjacent to each of the magnetic yokes 104 are gathered toward the magnetic yoke 104 interposed therebetween, and are thereby guided toward the second sections 204*b* of the separation unit 200 in parallel to the magnetic yoke 104, thereby making the second sections 204*b* the main separation portions in the magnetic separation device 400 for separating magnetic substances in a solution of bio-sample. The first section 204*a* in the separation unit 200 which is adjacent to each of the magnets 102 may function as an inlet and an outlet of the solution of bio-sample and interconnect the second sections 204*b*. Portions of the first sections 204*a* adjacent to the second sections 204*b* may also provide separation efforts due to a close placement thereof near the magnetic yokes 104. In addition, more than one set of the magnetic field units can be disposed in the magnetic separation device 400 to further improve magnetic field strength such that the efficiency of the magnetic separation improves.

Figure 11:
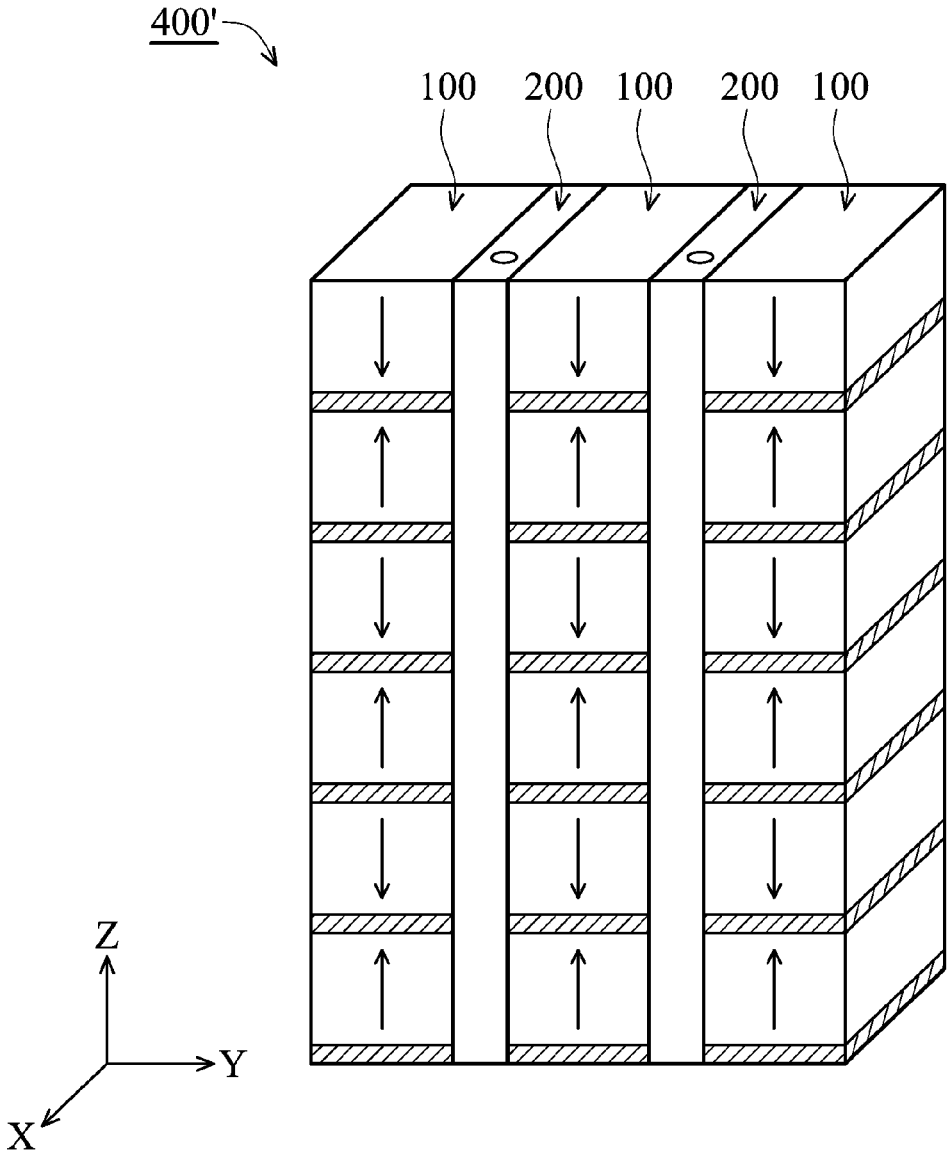
FIG. 11 is a schematic diagram showing a magnetic separation device according to another embodiment of the invention.

In other embodiments, numbers and configurations of the separation units 200 and the magnetic field units 100 disposed in a magnetic separation device are not limited by those illustrated in FIG. 10. As shown in FIG. 11, a separation unit can be respectively interposed between a number of n (n is an integer greater than 2 and n=3 in this embodiment) magnetic field units such that the magnetic separation device provides a magnetic separation device 400' comprising n magnetic field units and n−1 separation units.

Figure 12:
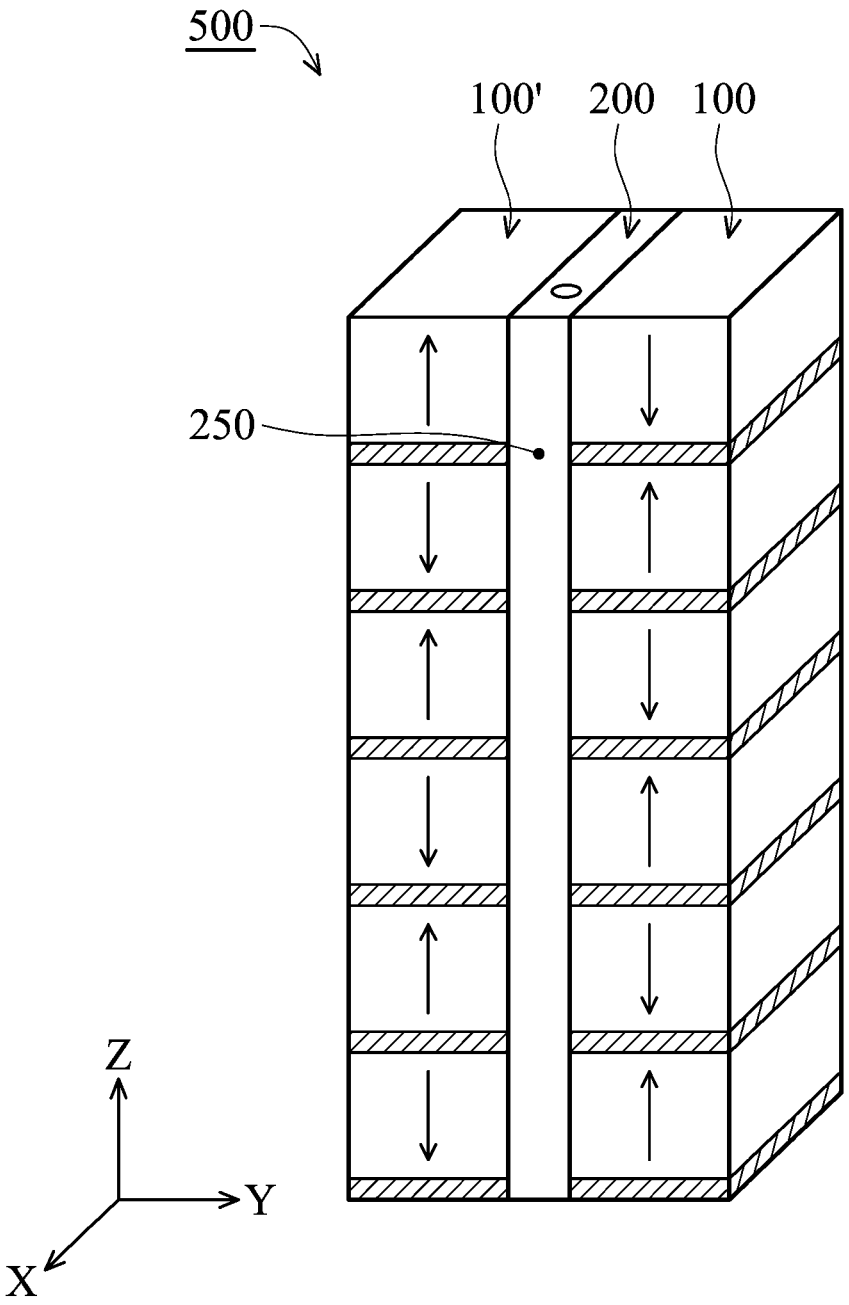
FIG. 12 is a schematic diagram showing a magnetic separation device according to yet another embodiment of the invention.
Figure 13:
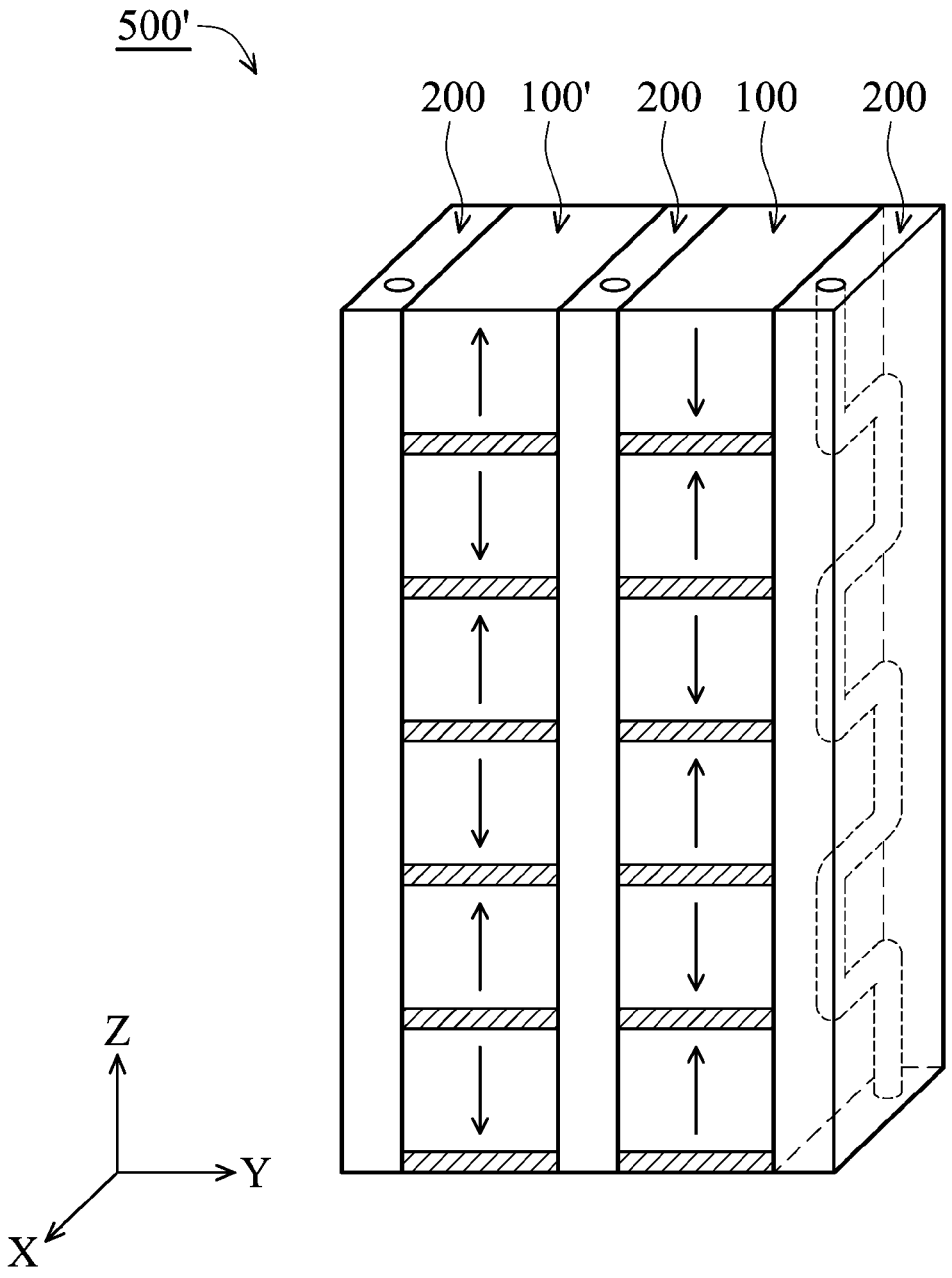
FIG. 13 is a schematic diagram showing a magnetic separation device according to another embodiment of the invention.

FIG. 12 illustrates another exemplary magnetic separation device 500 formed by replacing one of the magnetic field units 100 therein with the magnetic field unit 100' shown in FIG. 2. FIG. 13 illustrates an exemplary magnetic separation device 500' formed by replacing one of the n magnetic field units 100 with the magnetic field unit 100' illustrated in FIG. 2. The above illustrated configurations of the magnetic separation device are good for improving efficiency of the magnetic separation process provided thereby.

Figure 14:
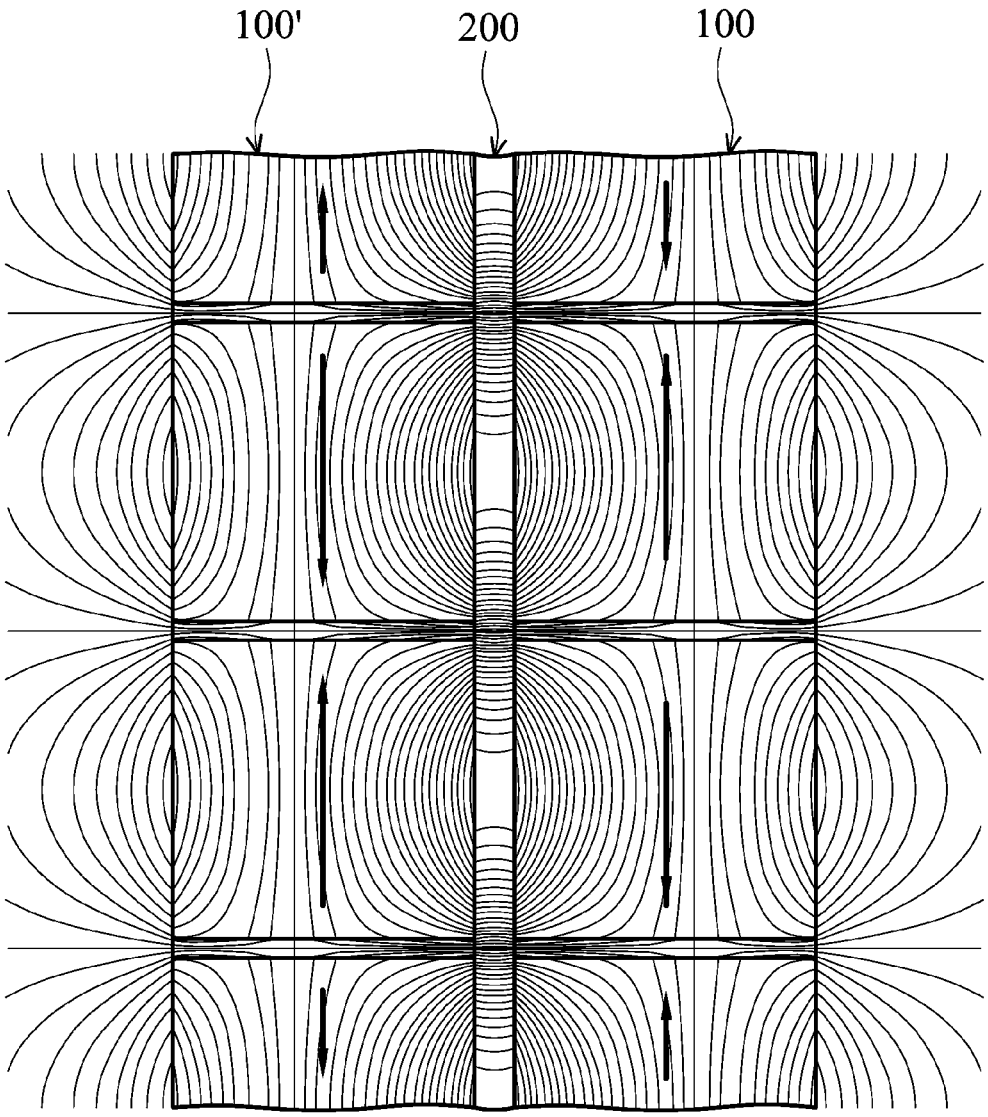
FIG. 14 is a schematic diagram showing magnetic flux lines in the magnetic separation device shown in FIG. 12.

FIG. 14 is a schematic diagram showing magnetic flux lines in the magnetic separation device 500 shown in FIG. 12. The magnets 102 located at adjacent places in the different magnetic field units 100 and 100' of the magnetic separation device 500 are now provided with different directions of magnetization, such that the magnetic flux lines are gathered by the magnetic yokes 104 of the magnetic field unit 100 at the right side and are guided thereof toward an outer side of the magnetic field unit 100, and then pass through the second sections 204*b* of the separation unit 200 such that being guided through the magnetic yokes 104 toward the magnets 102 having opposite direction of magnetization of the magnetic field unit 100' at a left side. Such a configuration further improves efficiency of a magnetic separation.

Figure 15:
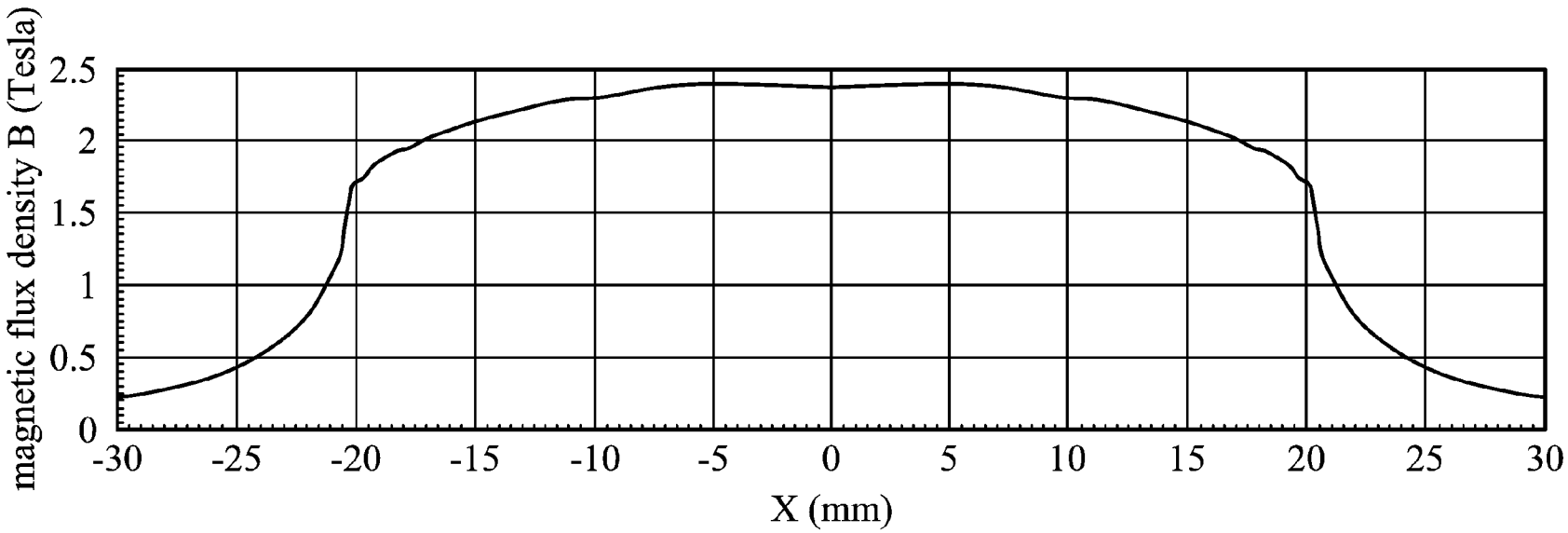
FIGS. 15 and 16 are diagrams showing magnetic flux density analysis results along an X axis and a Z axis of the magnetic separation device shown in FIG. 12, respectively.
Figure 16:
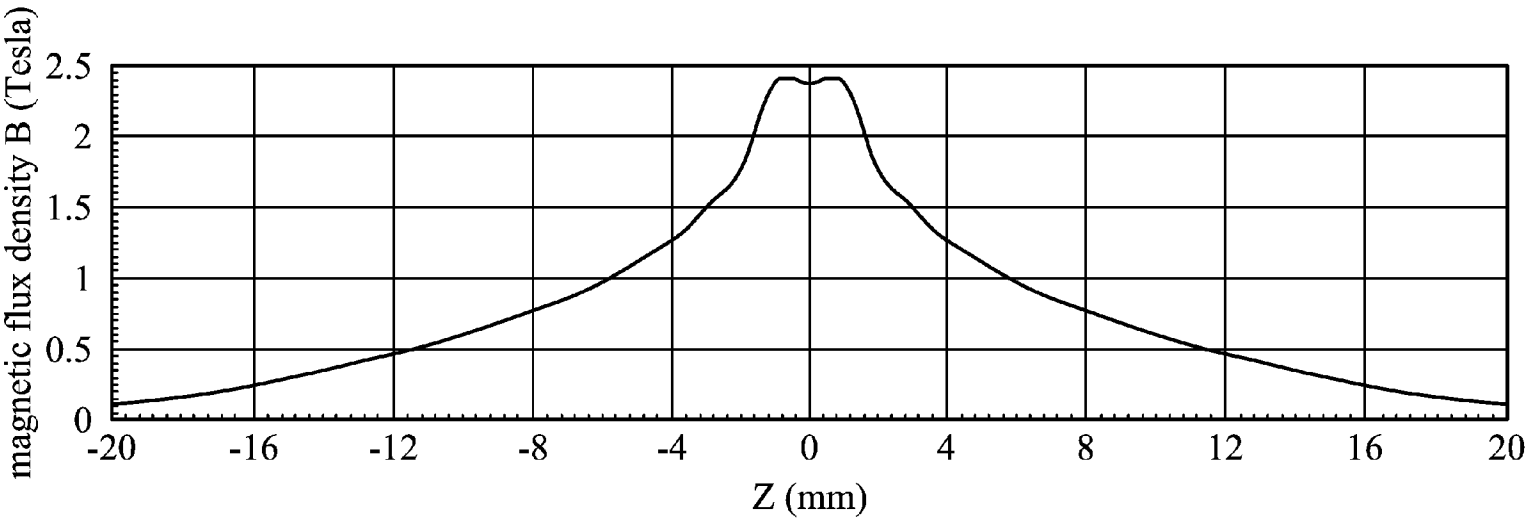

FIGS. 15 and 16 illustrate magnetic flux density test results along an X axis and a Z axis of a center 250 of the separation unit 200 in the magnetic separation device 500 illustrated in the FIG. 12, wherein the unit of the magnetic flux density is represented in Tesla, and 1 Tesla is equal to 10 kG.

In this embodiment, the magnets 102 used in the magnetic field unit 100 and 100' of the magnetic separation device 500 were NdFeB magnets having magnetic properties such as Br=13.6 kG and Hc=10.5 kOe. The magnetic yokes 104 interposed between the magnets 102 were formed of pure iron, having an overall square size of (length×width) 40 mm by 40 mm and a thickness of about 2 mm. The magnetic filed units 100 and 100' were provided with a distance of about 5 mm therebetween. According to magnetic flux density distribution analysis, maximum magnetic field strength of about 23.7 kG between the magnetic units 100 and 100' was found near the sidewall 120 of the magnetic yoke 104. In addition, maximum magnetic field strength of about 22.5 kG between the magnetic units 100 and 100' was also found near the sidewall 120 of the magnetic yoke 104 while the magnetic yokes 104 were replaced by magnetic yokes made of magnetic stainless steel.

Figure 17:
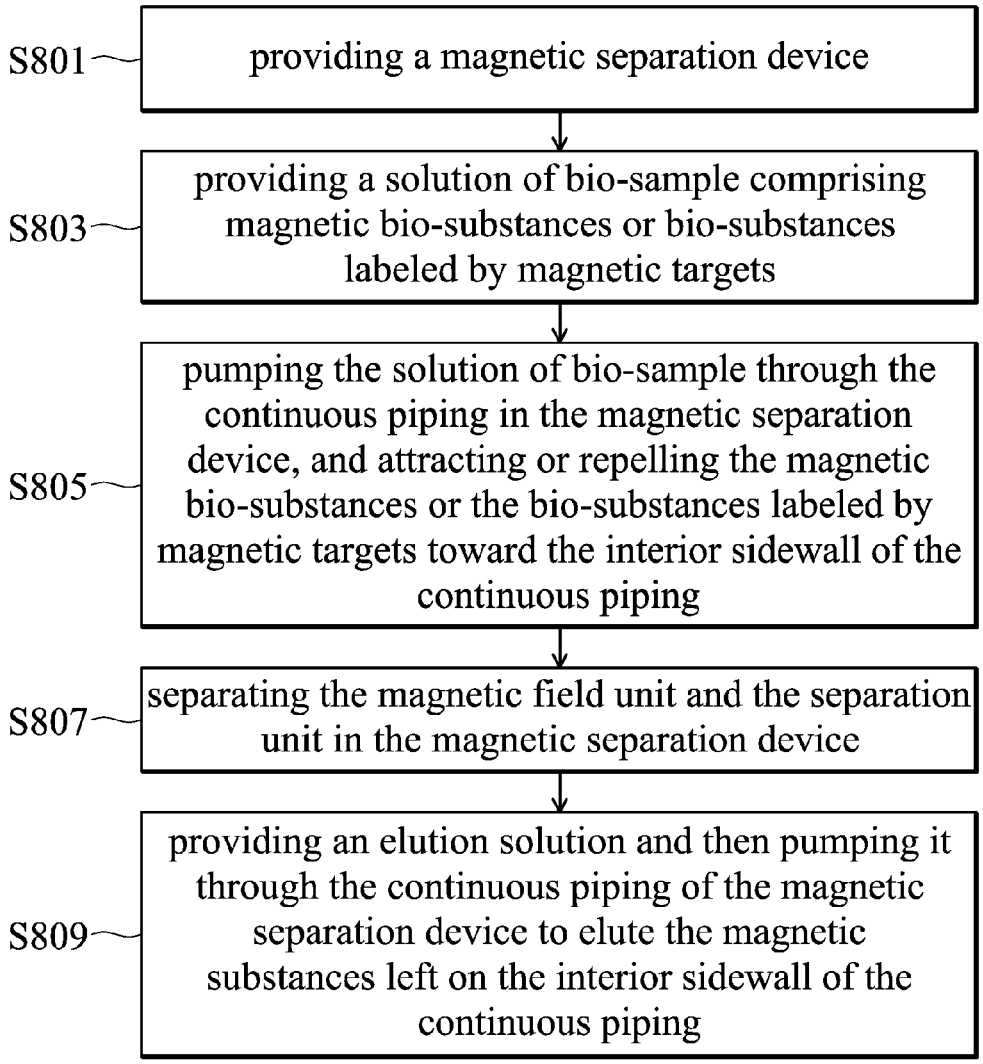
FIG. 17 is a flow chart showing a method for separating magnetic substances in bio-samples according to an embodiment of the invention.

FIG. 17 illustrates a flow chart of a method for separating magnetic substances in bio-samples.

First, in step S801, a magnetic separation device such as one of the magnetic separation devices illustrated in FIGS. 8-13 is provided. Next, in step S803, a solution of the bio-sample comprising magnetic substances is provided. The magnetic substances can be magnetic bio-substances or bio-substances labeled by magnetic targets.

Next, in step 805, the solution of bio-sample is then pumped through the continuous piping in the magnetic separation device and the magnetic substances therein will be attracted or repelled toward the interior sidewalls of the continuous piping, such as toward the interior sidewalls of the second sections of the continuous piping near the magnetic yoke and portions of interior sidewalls of the first sections of the continuous piping near the magnetic yoke.

Next, in step S807, the magnetic field unit and the separation unit in the magnetic separation device are separated by individually removing the separation unit or the magnetic field unit, preferably by removing the separation unit.

Finally, in step S809, an elution solution is provided and then flowed through the continuous piping of the magnetic separation device to elute the magnetic substances left on the interior sidewalls of the second sections and portions of the first sections in the continuous piping.

In one embodiment, the solution of the bio-sample may flow through magnetic separation device and may comprise magnetic substances or bio-substances labeled by magnetic targets. For example, blood samples, condensed blood samples, tissue samples, tissue solution samples, cell samples, cell culture samples, microorganism samples, protein samples, amino acid samples, and nucleic acid samples. The magnetic substances can be, for example, particles of metals such as Fe, Co, Ni, or oxide particles thereof. The buffer solution can be, for example, Tris-buffer saline (TBS), phosphate buffer saline (PBS), normal saline, and solutions having the same tension as a culture solution and other solutions capable of maintaining activities of proteins, amino acids or nucleic acids.

Example 1

A magnetic separation device as illustrated in FIG. 12 was provided, comprising magnets 102 made of NdFeB (Br=13.6 kG and Hc=10.5 kOe) and an overall size (length×width×height) of 20 mm×20 mm×20 mm. The magnetic yokes 104 were made of pure iron and was formed with an overall rectangular size (length×width) of 20 mm×20 mm and a thickness of about 2 mm. The magnetic field units 100 and 100' were provided with a distance of 5 mm therebetween, and adjacent magnets 102 in magnetic field units 100 and 100' were provided with opposite magnetic directions.

According to magnetic field test results, the maximum magnetic field strength of about 17.9 kG between the magnetic field units 100 and 100' was measured at a place near the magnetic yokes 104. In addition, another magnetic field strength of about 17.9 kG between the magnetic field units 100 and 100' was also measured while the thickness of the magnetic yokes 104 was changed to 1 mm.

Example 2

A magnetic separation device as illustrated in FIG. 12 was provided, comprising magnets 102 made of NdFeB (Br=13.6 kG and Hc=10.5 kOe) and an overall size (length×width×height) of 30 mm×30 mm×20 mm. The magnetic yokes 104 were made of pure iron and were formed with an overall rectangular size (length×width) of 30 mm×30 mm and a thickness of about 2 mm. The magnetic field units 100 and 100' were provided with a distance of 5 mm therebetween, and adjacent magnets 102 in magnetic field units 100 and 100' were provided with opposite magnetic directions.

According to magnetic field test results, a maximum magnetic field strength of about 19.5 kG between the magnetic field units 100 and 100' was measured at a place near the magnetic yokes 104. In addition, another magnetic field strength of about 21.4 kG between the magnetic field units 100 and 100' was also measured while a height of the magnets 102 was changed to 30 mm.

Example 3

A magnetic separation device as illustrated in FIG. 12 was provided, comprising magnets 102 made of NdFeB (Br=13.6 kG and Hc=10.5 kOe) and an overall size (length×width×height) of 40 mm×40 mm×20 mm. The magnetic yokes 104 were made of pure iron and were formed with an overall rectangular size (length×width) of 40 mm×40 mm and a thickness of about 2 mm. The magnetic field units 100 and 100' were provided with a distance of 5 mm therebetween, and adjacent magnets 102 in magnetic field units 100 and 100' were provided with opposite magnetic directions.

According to magnetic field test results, a maximum magnetic field strength of about 20.6 kG between the magnetic field units 100 and 100' was measured at a place near the magnetic yokes 104. In addition, other magnetic field strengths of about 19.0 kG and 19.1 kG between the magnetic field units 100 and 100' were also measured while the magnetic yokes 104 were replaced with magnetic yokes made of soft magnetic stainless steel of a thickness of about 2 mm and 1 mm, respectively.

Example 4

A magnetic separation device as illustrated in FIG. 12 was provided, comprising magnets 102 made of NdFeB (Br=13.6 kG and Hc=10.5 kOe) and an overall size (length×width×height) of 40 mm×40 mm×40 mm. The magnetic yokes 104 were made of pure iron and were formed with an overall rectangular size (length×width) of 40 mm×40 mm and a thickness of about 2 mm. The magnetic field units 100 and 100' were provided with a distance of 5 mm therebetween, and adjacent magnets 102 in the magnetic field units 100 and 100' were provided with opposite magnetic directions.

According to magnetic field test results, a maximum magnetic field strength of about 23.7 kG between the magnetic field units 100 and 100' was measured at a place near the magnetic yokes 104. In addition, another magnetic field strength of about 22.5 kG between the magnetic field units 100 and 100' was also measured while the magnetic yokes in 104 were replaced by magnetic yokes made of soft magnetic stainless steel.

Example 5

A magnetic separation device as illustrated in FIG. 10 was provided, comprising column magnets 102 made of NdFeB (Br=13.6 kG and Hc=10.5 kOe), having a diameter of about 23.6 mm and a height of about 22 mm. The magnetic yokes 104 were circular magnetic yokes made of pure iron and were formed with a diameter of 23.6 mm and a thickness of about 2 mm. The two magnetic field units 100 were provided with a distance of 10 mm therebetween.

According to magnetic field test results, a maximum magnetic field strength of about 10.2 kG between the two magnetic field units 100 was measured at a place near the magnetic yokes 104. The magnetic field strength was adjusted by changing the distance between the two magnetic field units 100, and the magnetic field strength was increased while the distance between the two magnetic field units 100 was reduced. In addition, one of the magnetic field units 100 was replaced by the magnetic field unit 100' and a maximum magnetic field strength of about 16.0 kG between the magnetic field units 100 and 100' was measured at a place near the magnetic yokes 104.

Example 6

A magnetic field unit illustrated in FIG. 1 was provided, having the magnets 102 therein made of NdFeB (Br=11.5 kG) and with a diameter of about 23.6 mm and a height of about 22 mm, and the magnetic yokes 104 made of iron and with a diameter of about 23.6 mm and a thickness of about 2 mm. The magnetic field unit was enclosed in a non-magnetic stainless piping and magnetic field strength of about 12 kG at a surface of the stainless piping near the magnetic yokes 104 were measured. A magnetic separation device as illustrated in FIG. 12 was provided, comprising a pair of the above magnetic field units assembled with a distance of about 3.5 mm therebetween and maximum magnetic field strength of about 15 kG was measured at a gap between this two magnetic field units.

Example 7

A magnetic separation device as illustrated in FIG. 12 was provided, comprising magnets 102 made of NdFeB (Br=13.6 kG and Hc=10.5 kOe) and an overall size (length×width×height) of 40 mm×40 mm×40 mm. The magnetic yokes 104 were made of pure iron and was formed with an overall rectangular size (length×width) of 40 mm×40 mm and a thickness of about 2.4 mm. The magnetic field units 100 and 100' were provided with a distance of 3 mm therebetween and a maximum magnetic field strength of about 22 kG was measured.

Separation efficiency tests were held in this magnetic separation device and a plurality of solutions of bio-sample were pumped through a continuous piping in which the length of the second section is about 40 mm, wherein bio-sample 1 was a solution comprising $Fe_3O_4$ made of chemical solution synthesis with particles of a size of 30 mm therein, and bio-sample 2 was a solution comprising commercially obtained products of Dynabeads® MyOneTMCarboxylic Acid provided by invitrogen, having particle sizes of 1 μm.

The above bio-samples were pumped through the magnetic field for separation and the Fe contents in solution were measured by an Inductively Coupled plasma-Optical Emission Spectrometry (ICP-OES). Table 1 shows measurement results and separation efficiency of the bio-samples 1 and 2 are 99.88% and 98.56%, respectively.

TABLE 1

| | | | | | |
|---|---|---|---|---|---|
| Bio-sample 1 | Before separation | 2.3 mg/g | Bio-sample 2 | Before separation | 0.3 mg/g |
| | After separation | 0.0027 mg/g | | After separation | 0.0043 mg/g |
| | Separation efficiency | 99.88% | | Separation efficiency | 98.56% |

Example 8

Separation efficiency tests were held by using the magnetic separation device disclosed in example 7. Test samples were mixtures of peripheral blood mononuclear cells (PBMC) and Dynambeads CD19 (a magnetic bead product of invitrogen, having a diameter of about 4.5 μm) mixed for 20 minutes to make cells therein adhered with magnetic beads. A mixture of 1 ml was picked up and then continuously passed through the length of piping and an flow-through solution was collected, a buffer solution of 1 ml was prepared and then pumped through the continuous piping twice in order to collect the buffer-eluting solution.

The continuous piping was removed from the magnetic separation device and the cells with the magnetic beads were then eluted from the continuous piping by elution. According to microscope observations, cells bonded with magnetic beads and individual magnetic beads ware found in the final elution solution, and no cell bonded with magnetic beads was found in the flow-through solution and buffer-eluting solution. This means that the cells bonded with magnetic beads can be separated by the magnetic separation device. In addition, Fe contents in the fluid were measured by an Inductively Coupled plasma-Optical Emission Spectrometry (ICP-OES) before and after separation, and a separation efficiency of about 98.58% was obtained.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A magnetic separation device, comprising:

a first magnetic field unit, comprising:

a plurality of first magnets; and a plurality of first magnetic yokes respectively interposed between the plurality of first magnets, wherein a same magnetic pole of each adjacent two first magnets is facing the respective first magnetic yoke interposed therebetween, a gap is formed between each adjacent two of the first magnets and a first sidewall of the respective first magnetic yoke interposed therebetween not in contact with the adjacent two of the first magnets, and the first magnetic yokes and the first magnets are formed from different materials; and a first separation unit, comprising:

a body made of non-magnetic materials disposed adjacent to a first side of the first magnetic field unit; and a continuous piping disposed in the body, comprising a plurality of second sections interposed respectively between a plurality of first sections, wherein the second sections are perpendicular to the first sections, and each second section is respectively adjacent to and parallel to the first sidewall of a corresponding one of the first magnetic yokes, wherein each second section has a portion protruding from a first side of the body of the first separation unit and received in the gap formed by the first sidewall of the corresponding one of the first magnetic yokes.

2. The magnetic separation device as claimed in claim 1, wherein the sidewall of each of the first magnetic yokes has a planar surface, a curved surface or a convex surface.

3. The magnetic separation device as claimed in claim 1, wherein the plurality of first magnetic yokes comprise pure iron, magnetic stainless steel, metal soft magnetic materials having predetermined permeability, or soft magnetic ferrites.

4. The magnetic separation device as claimed in claim 1, wherein the first magnets comprise NdFeB, SmCo, SmFeN, AlNiCo, or ferrite.

5. The magnetic separation device as claimed in claim 1, wherein body comprises polymethyl methacrylate, acrylic, polypropylene, polyethylene, polyvinyl chloride, Teflon, or bakelite.

6. The magnetic separation device as claimed in claim 1, wherein the continuous piping comprises polymethyl methacrylate, polyvinyl chloride, polyurethane, silicon, or Teflon.

7. The magnetic separation device as claimed in claim 1, wherein the first magnets are circular pillars or polygonal pillars.

8. The magnetic separation device as claimed in claim 1, further comprising a second separation unit disposed adjacent to a second side of the first magnetic field unit, the second separation unit comprising a body made of non-magnetic materials and a continuous piping disposed in the body, the continuous piping comprising a plurality of second sections interposed respectively between a plurality of first sections, wherein the second sections are perpendicular to the first sections, and each second section is respectively adjacent to and parallel to a second sidewall of a corresponding one of the first magnetic yokes not contacting the adjacent two of the first magnets.

9. The magnetic separation device as claimed in claim 8, wherein the first and second separation units are disposed at adjacent sides or opposite sides of the first magnetic field unit.

10. The magnetic separation device as claimed in claim 1, further comprising a second magnetic field unit disposed adjacent to the first separation unit, comprising:

a plurality of second magnets; and a plurality of second magnetic yokes respectively interposed between the plurality of second magnets, wherein a same magnetic pole of each adjacent two second magnets is facing the respective second magnetic yoke interposed therebetween.

11. The magnetic separation device as claimed in claim 10, wherein the second magnetic field unit and the first magnetic field unit are disposed at opposite sides of the first separation unit, and a magnetic direction of the second magnets are opposite to a magnetic direction of the first magnets adjacent thereto.

12. The magnetic separation device as claimed in claim 10, wherein the second magnetic yokes physically contact the first separation unit.

13. The magnetic separation device as claimed in claim 10, wherein a gap is formed between each adjacent two of the second magnets and a sidewall of the respective second magnetic yoke interposed therebetween not in contact with the adjacent two of the second magnets.

14. The magnetic separation device as claimed in claim 13, wherein the sidewall of each of the second magnetic yokes has a planar surface, a curved surface or a convex surface.

15. The magnetic separation device as claimed in claim 13, wherein each of the second sections is respectively adjacent to and parallel to the sidewall of a corresponding one of the second magnetic yokes, wherein each second section has a portion protruding from a second side of the body of the first separation unit and received in the gap formed by the sidewall of the corresponding one of the second magnetic yokes.

16. The magnetic separation device as claimed in claim 10, wherein the second magnetic yoke comprises pure iron, magnetic stainless steel, soft metal magnetic materials having predetermined permeability, or soft magnetic ferrites.

17. The magnetic separation device as claimed in claim 10, wherein the second magnets comprise NdFeB, SmCo, SmFeN, AlNiCo, or ferrite.

18. The magnetic separation device as claimed in claim 10, wherein the second magnets are circular pillars or polygonal pillars.

19. A method for separating magnetic substances in a bio-sample, comprising:

providing a magnetic separation device as claimed in claim 1;

providing a solution of bio-sample, wherein the solution of bio-sample comprises magnetic bio-substances or bio-substances labeled by magnetic target;

pumping the solution of bio-sample through the continuous piping in the magnetic separation device, thereby attracting or repelling the magnetic bio-substances or bio-substances labeled by magnetic target toward a sidewall of one of the second sections adjacent to and in parallel to one of the plurality of first magnetic yokes and portions of a sidewall of the first sections;

separating the first magnetic field unit from the first separation unit; and providing a buffer solution and pumping the buffer solution through the continuous piping of the first separation unit, thereby eluting the magnetic bio-substances or bio-substances labeled by magnetic targets left on the sidewall of one of the second sections and portions of the sidewall of the first sections.

20. The method as claimed in claim 19, wherein the magnetic bio-substances or the bio-substances labeled by magnetic target in the bio-sample solution are cells, microorganisms, proteins, amino acids, nucleic acids.

21. The method as claimed in claim 19, wherein the magnetic targets are particles of iron, cobalt, nickel, or oxides thereof.

22. The method as claimed in claim 19, wherein the buffer solution comprises Tris-buffer saline, phosphate buffer saline, normal saline, solutions having same tension as a culture solution, or solutions capable of maintaining activities of proteins, amino acids or nucleic acids.

* * * * *